United States Patent [19]

Mott

[11] 4,074,761

[45] Feb. 21, 1978

[54] DRILLING TOOL

[75] Inventor: James D. Mott, Houston, Tex.

[73] Assignee: Hydril Company

[21] Appl. No.: 212,260

[22] Filed: Dec. 27, 1971

[51] Int. Cl.[2] ..... E21B 43/00; E21B 41/00

[52] U.S. Cl. ..... 166/315; 137/496; 166/324; 175/318

[58] Field of Search ..... 166/314, 315, 53, 68, 166/72, 115, 224, 224 S; 137/505.14, 505, 495, 496; 175/38, 232, 241, 242, 317, 318

[56] References Cited

U.S. PATENT DOCUMENTS

| | | | |
|---|---|---|---|
| Re. 25,471 | 11/1963 | Fredd | 166/224 A |
| 2,921,601 | 1/1960 | Fisher, Jr. | 137/496 |
| 3,035,808 | 5/1962 | Knox | 251/58 |
| 3,078,923 | 2/1963 | Tausch | 116/224 A |
| 3,200,837 | 8/1965 | Brown | 137/496 |
| 3,667,557 | 6/1972 | Todd | 175/318 |
| 3,675,720 | 7/1972 | Sizer | 166/314 |
| 3,696,868 | 10/1972 | Taylor, Jr. | 166/315 |
| 3,741,249 | 6/1973 | Leutwyler | 166/224 |

*Primary Examiner*—James A. Leppink
*Attorney, Agent, or Firm*—Pravel, Wilson & Gambrell

[57] ABSTRACT

A well drilling tool including a tubular member having a bore therethrough and adapted for connection in a drilling string to form a flow passage for drilling fluid and a full opening rotatable ball type bore closure means pivotally mounted with the tubular member in the bore of the tubular member for enabling desired flow down the bore of the drill string and which automatically rotates closed when incipient well pressure conditions indicate the direction of flow in the bore may be reversed. The drilling tool includes a means for releasably locking the ball in the open position in response to a predetermined directional pressure in the bore to render inoperative the automatic operation of the ball. The drilling tool may be employed by stabbing the tool in a drilling string having an upwardly flow in the bore of the drilling string to connect the tool with the drilling string for subsequently blocking the upwardly flow.

29 Claims, 10 Drawing Figures

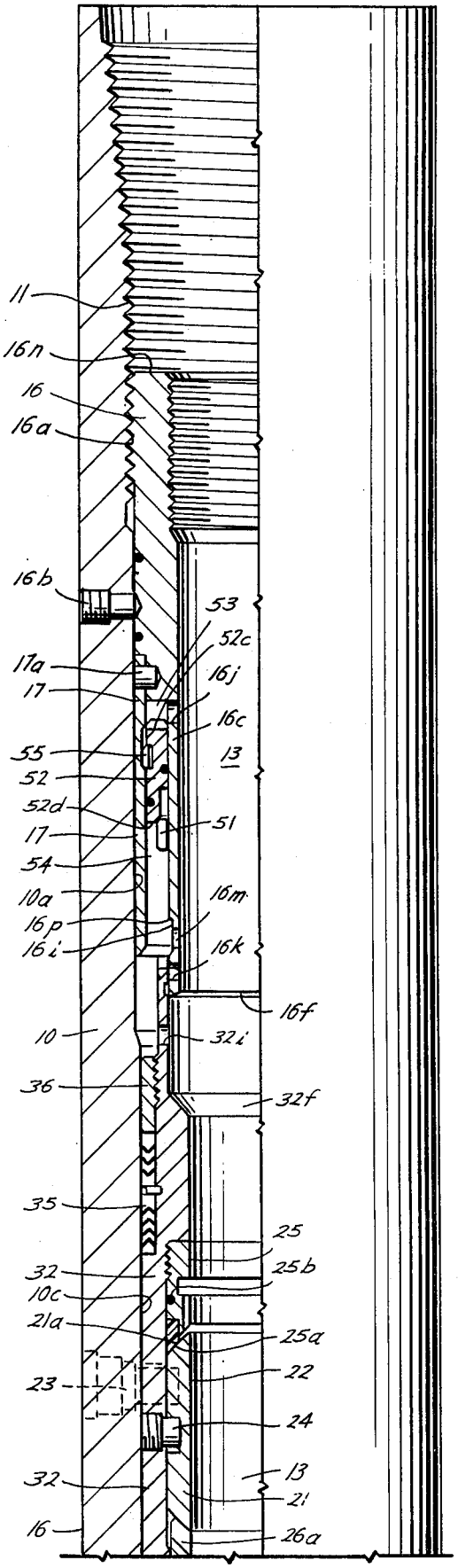
Fig. 2A
Fig. 2B
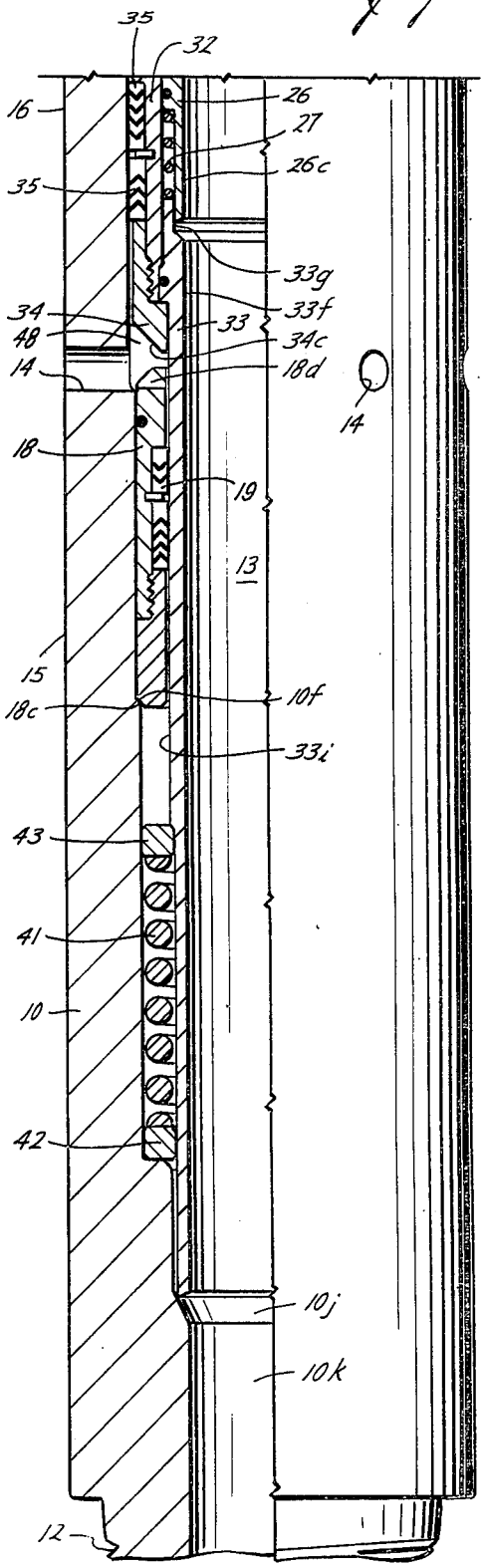

DRILLING TOOL

CROSS REFERENCE TO RELATED APPLICATION

This application is related to my copending application Ser. No. 201,878, filed Nov. 24, 1971, entitled "Drilling Tool" and now U.S. Pat. No. 3,783,942.

BACKGROUND OF THE INVENTION

This invention relates to the field of an inside-the-pipe blowout preventer.

My copending application for a "Drilling Tool", Ser. No. 201,878, discloses a full bore pressure responsive rotatable ball valve inside blowout preventer to automatically control well blowouts in the bore of the drill string. That invention significantly enhances the safety of the drilling crew and equipment from the dangers of a well blowout, but lacked a suitable sealing arrangement to prevent leakage of fluid from the bore of the tool into the well annulus when the valve operated. The longitudinal movement of the ball member of that invention needed to effect rotation of the ball required the application of large urging forces resulting in greater metal wear and a shorter reliable operating tool life.

An object of the present invention is to provide a new and improved inside blowout preventer drilling tool.

A further object of the present invention is to provide a new and improved pressure responsive inside blowout preventer drilling tool.

Yet another object of the present invention is to provide a new and improved inside blowout preventer drilling tool which may be stabbed in a drill string having a blowout flow therethrough.

SUMMARY OF THE INVENTION

This invention relates to a new and improved inside blowout preventer drilling tool.

The drilling tool includes a tubular member having a longitudinal bore therethrough and adapted for connection in a drill string to form a flow passage through the bore for circulating a drilling fluid to a drill bit. The drilling tool includes a full opening ball-type closure means pivotally mounted in the bore of the tubular member for enabling desired flow down the bore of the drill string and which automatically rotates closed when incipient well pressure conditions indicate the direction of flow through the bore may be reversed. A pressure responsive piston is pivotally connected with the ball to effect opening rotation of the ball when the piston moves in response to the pressure in the bore exceeding the pressure adjacent the exterior of the well tool by a predetermined value. The pressure adjacent the tubular member and an urging means normally maintain the ball in the closed position by urging on the continuously seated piston. The ball may be releasably locked in the open position by a preselected directional pressure in the bore. The drilling tool may also be employed, when desired, by stabbing the tool in a drilling string having an upward flow in the bore to connect the tool with the drilling string for blocking the upwardly flow.

BRIEF DESCRIPTION OF THE DRAWINGS

FIGS. 2A and 2B are views similar to FIGS. 2A and 2B, respectively, illustrating the well tool in the open position;

DESCRIPTION OF THE PREFERRED EMBODIMENT

Figure 1A:
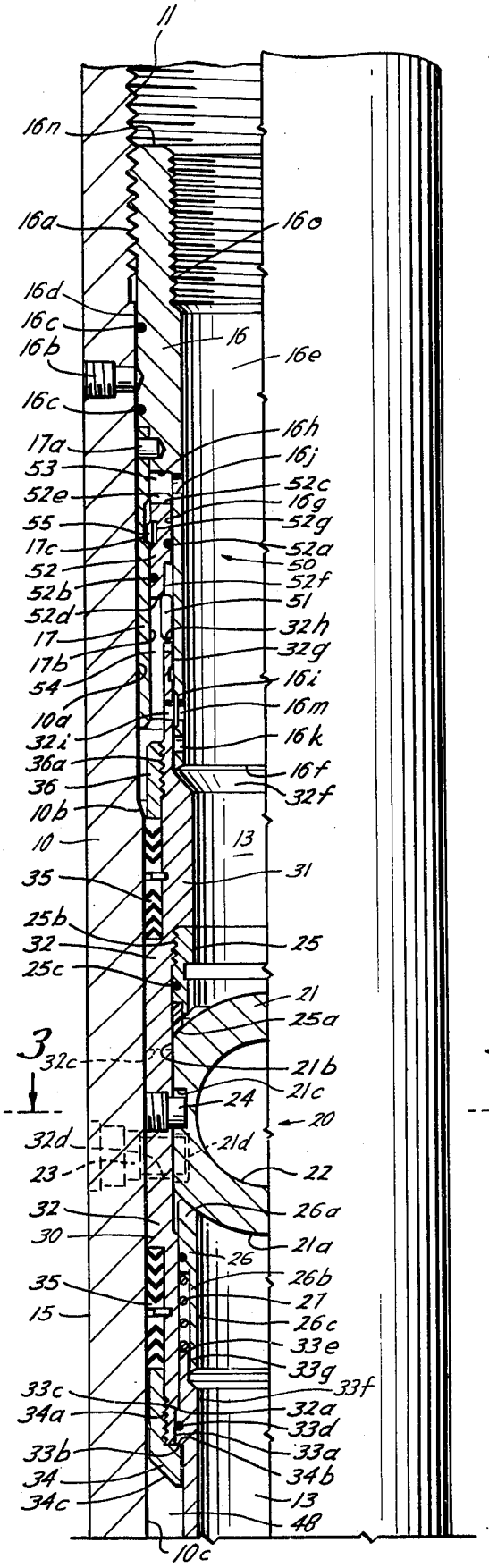
FIGS. 1A and 1B are side views, partially in section, illustrating the drilling tool of the present invention in the closed position.
Figure 1B:
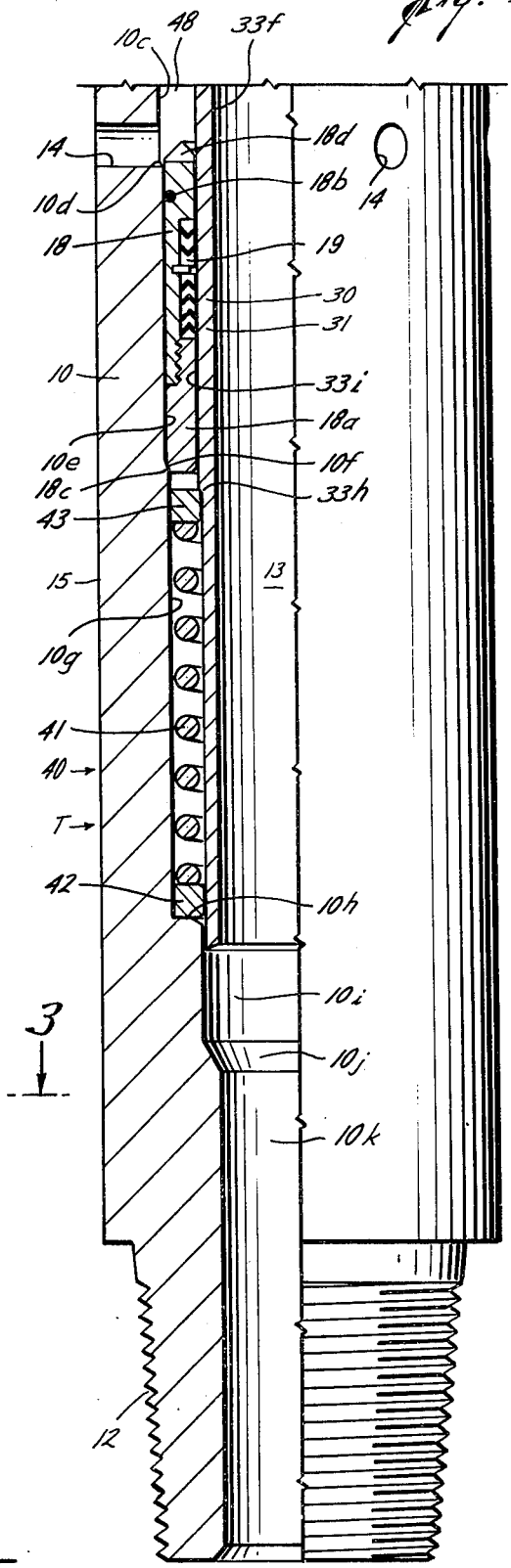
Figure 3:
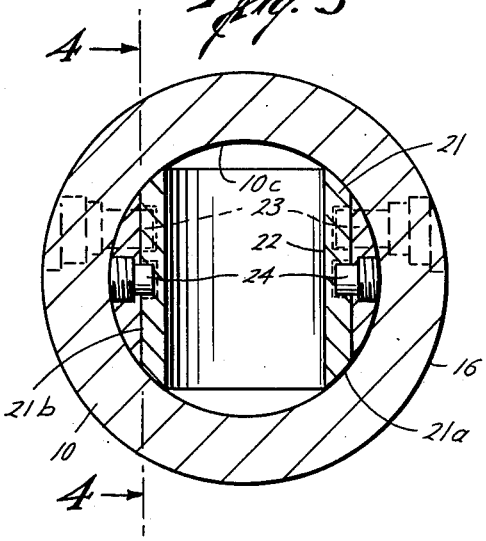
FIG. 3 is a view taken along line 3—3 of FIG. 1A.

Attention is directed to FIGS. 1A and 1B where the drilling tool of the present invention is generally designated T. The drilling tool T includes a tubular member 10 adapted for connection in a drilling string (not illustrated) at its upper and lower ends. The tubular member 10 is connected to a portion of the drilling string above the tubular member 10 with a threaded box connection 11 at the upper end of the tool T. The tubular member 10 has a lower threaded pin connection 12 for securing the tubular member 10 with a portion of the drilling string beneath the tool T.

The tubular member 10 has a longitudinal bore 13 formed therethrough for communicating the bore of the tubular drill string above the tool T with the bore of the drill string below the tool T. The bore 13 is defined in greater detail from top to bottom of the tool T by a constant diameter inner surface 10*a*, a tapered annular surface 10*b*, a constant diameter inner surface 10*c*, an annular shoulder surface 10*d*, a constant diameter portion 10*e*, an annular shoulder 10*f*, a constant diameter portion 10*g*, an annular shoulder surface 10*h*, a constant diameter surface 10*i*, an annular shoulder surface 10*j*, and a lower constant diameter portion 10*k*. The bore 13 forms a flow passageway to enable the flow of drilling fluid down the bore of the drill string to the drill bit for flowing through a plurality of nozzles in the drill bit into the well as is well known in the art. The tubular member 10 has a port or flow channel 14 formed therethrough positioned adjacent the shoulder 10*d* for communicating the area adjacent the exterior surface 15 of the tubular member 10 with the bore 13. The pressure of the drilling fluid in the well circulating back to the surface along the exterior of the drill string is communicated through the port 14.

The tubular member 10 includes a fixed sleeve 16 which is preferably secured in the bore 13 by engaging the upper box spreads 11 with a threaded outer surface 16*a*. The tubular member 10 has an antirotation pin 16*b* secured to engage the sleeve 16 to block rotational movement therebetween disengaging the threads 16*a* and 11. The sleeve 16 carries a pair of O-rings 16*c* on an outer surface 16*d* of the sleeve 16 for sealing the sleeve 16 with surface 10*a* of the tubular member 10 to block passage of fluid therebetween. The sleeve 16 has concentrically mounted thereon an outer lower fixed sleeve 17 which is secured to the sleeve 16 by suitable fastening means such as pin 17*a*.

The drilling tool T includes a bore closure means 20 located in the bore 13 adjacent the constant diameter surface 10*c* of the tubular member 10 for moving to and from an open position enabling the desired flow of fluid through the bore 13 and a closed position for blocking flow through the bore 13. The bore closure means 20 includes a rotatable ball valve member 21 having an outer spherical surface 21*a* with a flow enabling bore 22 formed through the ball 21. The ball 21 has a pair of parallel flat portions 21*b* formed in the outer spherical surface 21*a* of the ball 21 with each of the flat circular portions 21*b* having a centered elongated recess 21*c* and a radially extending elongated recess 21*d* formed therein. The tubular member 10 has eccentrically secured thereto a pair of inwardly extending pivot pins 23 having a common longitudinal axis and which extend into the recesses 21*d* of the ball 21 for pivotally connecting the ball 21 with the tubular member 10. The bore closure means 20 includes a pair of inwardly-projecting pins 24 having a common longitudinal axis which are secured to a sleeve 32 and which extend into the eccentric recess 21*c* for operably connecting the sleeve 32 and the ball 21. The ball 21 is rotatable to and from an open or bore 22 aligned position (FIG. 2A) for enabling flow through the bore 13 of the tubular member 10 and to and from a closed or bore 22 transverse position (FIG. 1A) for blocking flow through the bore 13 of the tubular member 10. The bore closure means 20 includes a seat ring 25 located above the ball 21 which is secured to the sleeve 32. The seat ring 25 has a lower seating surface 25*a* for engaging the outer spherical surface 21*a* of the ball 21 to block leakage of fluid upwardly between the outer spherical surface 21*a* of the ball 21 and the seat ring 25. The seat ring 25 is preferably secured to the sleeve 32 by threads 25*b* and is sealed thereto by an O-ring 25*c* carried on the seat ring 25 to block leakage of fluid between the sleeve 32 and the seat ring 25.

The bore closure means 20 includes a means for spacing the ball 21 from the seating surface 25*a* of the seat ring 25 prior to commencing to impart rotation to the ball 21 to prevent scarring or other damage to the spherical surface 21*a* or the seating surface 25*a*. The spacing means includes a movable sleeve member 26 and a spring means 27 located in the bore 13 below the ball 21. The urging of the spring 27 imparted to the sleeve 26 moves the sleeve 26 upwardly to engage the outer spherical surface 21*a* of the ball with a plurality of upwardly extending spaced finger portions 26*a* of the sleeve 26. The urging of the spring 27 is thus imparted to the ball 21 for urging the ball 21 to move upwardly into engagement with the seating surface 25*a* of the seat ring 25 to effect the seal therebetween. The recesses 21*c* formed in the ball 21 are elongated to enable limited longitudinal movement of the ball 21 relative to the pins 24 positioned within the recesses 21*c*. This movement enabling clearance enables movement of the ball 21 downwardly to space the spherical surface 21*a* of the ball 21 from the seating surface 25*a* of the seat ring 25 when the upwardly urging of the spring 27 is overcome. The spacing of the ball 21 from the seat ring 25 tends to equalize the pressure in the bore 13 above and below the ball 21 enabling longitudinal movement of the ball 21 by a smaller urging force and reducing the ball 21 erroding initial flow velocity through the bore 22.

The drilling tool T includes a pressure responsive piston means 30 movably disposed in the bore 13 adjacent the surface 10*c* of the tubular member 10 operably connected with the ball 21 for effecting pressure responsive operation of the ball 21. Preferably, the piston means 30 includes a piston sleeve 31 comprising an upper sleeve portion 32 and a lower sleeve portion 33. The sleeves 32 and 33 are connected by suitable securing means to block relative movement therebetween. The lower end of the sleeve 32 has concentrically secured thereto a cap sleeve 34 by engagement of the threads 34*a* for securing the sleeve 32 with the lower sleeve 33. The cap sleeve 34 has an upwardly facing inner annular shoulder 34*b* for engaging a downwardly facing annular shoulder 33*b* of an outwardly extending collar 33*a* of the lower sleeve 33. The upper sleeve 32 has a downwardly facing inner annular shoulder 32*a* formed thereon to engage an upwardly facing annular shoulder 33*c* on the collar 33*a*. By securing the cap sleeve 34 and the sleeve 32 with the threads 34*a*, the collar 33*a* is engaged top and bottom to block any relative movement between the sleeve 32 and the sleeve 33. The sleeve 33 carries an O-ring 33*d* on the outer surface of the collar 33*a* to seal between the sleeves 32 and 33 to block leakage of fluid therebetween. The sleeve 33 has an upper annular shoulder surface 33*e* for mounting the lower end of the spring 27 to urge the sleeve 26 upwardly. The sleeve 33 has constant diameter inner surface 33*f* having a stepped upper portion 33*g* for guiding and for providing longitudinal movement enabling clearance to a lower skirt portion 26*a* and the sleeve 26. The inner surface 33*f* and a bore 26*c* of the ring 26 define the flow conduit or passage through the bore 13 below the ball 21.

The sleeve 32 has a pair of longitudinally extending windows or slots 32*b* formed therethrough for providing longitudinal movement enabling clearance to the sleeve 32 about the pins 23 secured with the tubular member 10 and extending through the slots 32*b* into the recesses 21*d* of the ball 21. As illustrated in FIG. 1A, the elongated slots 32*b* extend from an upper surface portion 32*c* to a lower surface portion 32*d*. The longitudinal movement of the piston sleeve 31 in the bore 13 effects movement of the ball 21 by pivot connecting pins 24 secured with the sleeve 32 to move the ball 21 from the closed position (FIGS. 1A and 1B) when the piston sleeve 31 is in the upper position to the open or bore aligned position (FIGS. 2A and 2B) for enabling flow through the bore 13 of the tubular member 10 when the piston sleeve 31 is in the lower position.

The sleeve 32 is sealed to the surface 10*c* of tubular member 10 by a pair of chevron packing rings 35 carried on the sleeve 32. The sleeve 34 secures the lower set of packings 35 with the sleeve 32 while the upper packing ring 35 is secured to the sleeve 32 by an upper sleeve 36 concentrically secured on the sleeve 32 by a suitable fastening means such as threaded engagement 36*a*.

As illustrated in FIG. 1B, the drilling tool T includes an urging means 40 for normally urging the piston sleeve 31 to move upwardly to effect closing rotation of the ball 21. The urging means 40 includes a spring means 41 concentrically mounted between the sleeve 33 and the surface 10*j* of the tubular member 10. The spring means 41 is positioned between a fixed spring keeper ring 42 and a movable spring keeper 43. The fixed keeper 42 engages the upwardly facing flat annular shoulder 10*k* of the tubular member 10 for mounting the lower end of the spring 41 with the tubular member 10. The movable keeper 43 engages a downwardly facing annular shoulder 33*h* formed on the sleeve 33 for imparting the upwardly urging of the spring 41 to the sleeve 33. The spring 41 is sustantially stronger than the spring 27 and will normally maintain the sleeve 31 in the upper position and the ball 21 is rotated closed.

The tubular member 10 includes a chevron packing carrier ring 18 secured in the bore 13 for sealing between the piston sleeve 31 and the tubular member 10. The packing keeper 18 carries a set of chevron packing rings 19 for sealing between an outer surface **33*i* of the lower sleeve 33 and the tubular member 10. The packing 19 is secured with the packing keeper 18 by a removable lower portion 18*a* of the packing keeper 18. The packing keeper 18 carries an O-ring 18*b* for blocking the leakage of fluid between the packing keeper 18 and the tubular member 10. The packing keeper 18 has a lower annular shoulder 18*c* for engaging the annular shoulder 10*f* of the tubular member 10 for blocking downwardly movement of the carrier ring 18. The packing keeper 18 has an upwardly facing annular shoulder 18*d* tapered to correspond to a downwardly facing annular shoulder 34*c* of the sleeve 34 to provide a lower movement limit stop to the piston sleeve 31 as well as providing a pressure responsive surface for the pressure urging thereon to move the carrier ring 18 into engagement with the shoulder 10*f* and maintain the ring 18** in that position.

The tubular member 10 and the piston sleeve 31 form an expansible annular chamber 48 therebetween communicating through the flow channel 14 with the area adjacent the exterior surface 15 of the tubular member 10. The expansible chamber 48 is defined in greater detail by a portion of the inner surface **10*c* of the tubular member 10, a downwardly facing annular surface 34*c* of the cap sleeve 34 below the lower packing 35, a portion of the outer surface 33*i* of the sleeve 33 between the seals of the O-ring 33*d* and the chevron packing 18 and the upper surface portion 18*d* of the keeper 18 between the packing 19 and the O-ring 18*b*. The fluid pressure within the chamber 48 will urge upwardly on an annular pressure responsive effective service area of the piston sleeve 31 extending outwardly from the seal effected by the packing 19 with the surface 33*i* of the sleeve 33 and the seal effected by the packing 35 with the surface 10*c* of the tubular member 10. The effective surface area of the piston sleeve 31 for urging upwardly movement thereof will be referred to hereinafter as being provided by the tapered annular surface 34*c***.

The sleeve 16 has a constant diameter inner surface **16*e* forming a portion of the flow passage through the bore 13 of the tubular member 10 above the piston sleeve 31. The sleeve 16 has a lower annular shoulder 16*f* for engaging an upwardly facing annular shoulder 32*f* for providing an upper movement limit stop for the piston means 30. The lower portion of the sleeve 16 has a constant diameter outer surface 16*g* concentrically spaced from the sleeve 17 to form an annular chamber which extends upwardly to the downwardly facing annular shoulder 16*h***.

Figure 6:
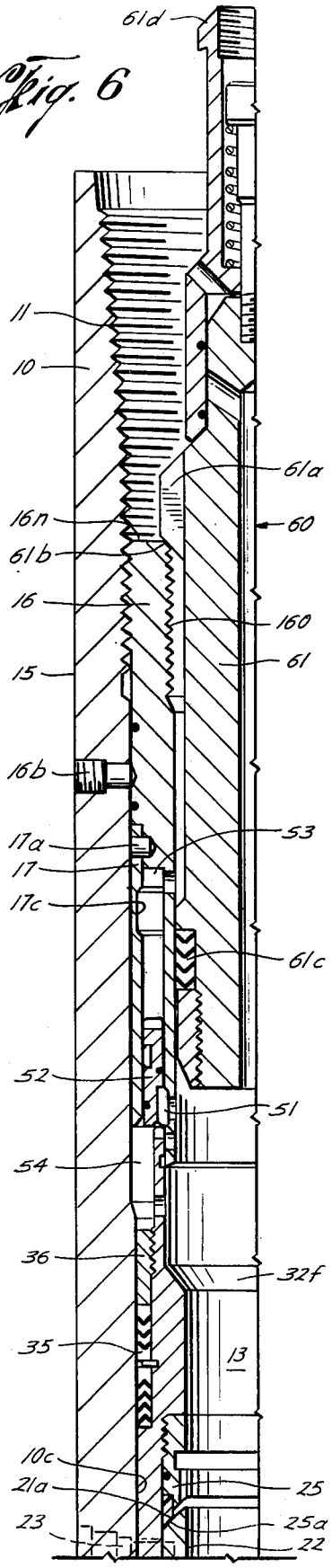
FIG. 6 is a side view, in section, of the upper portion of the drilling tool and a locking plug prior to locking the ball in the open position.
Figure 7:
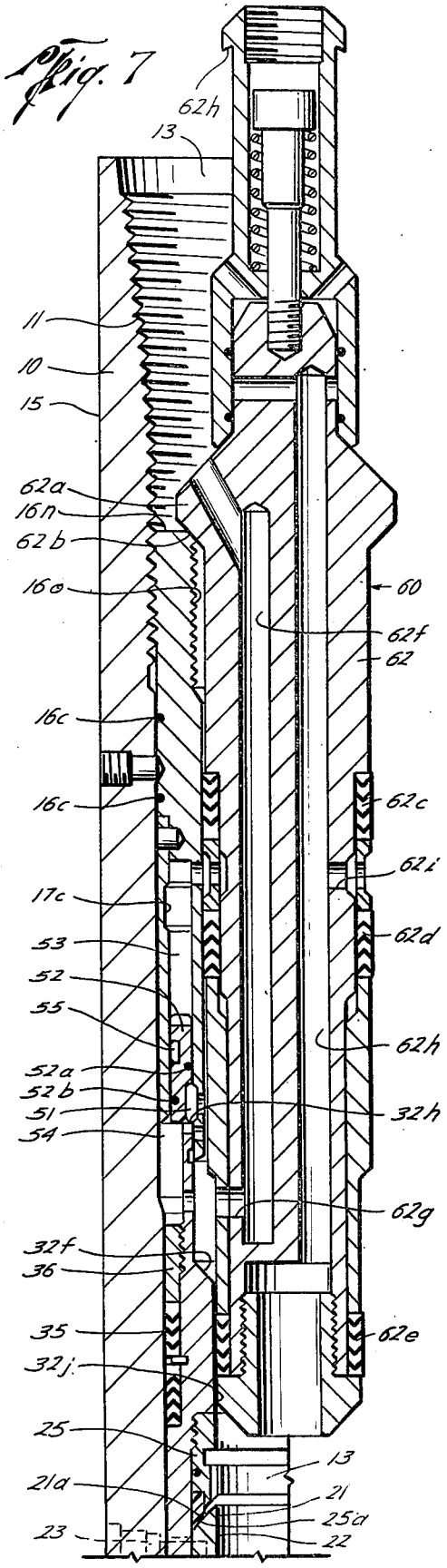
FIG. 7 is a view similar to FIG. 6 illustrating a bore plug positioned in the drilling tool for releasing the locked ball from the open position.

The drilling tool T includes a means 50 located in the annular space between the sleeves 16 and 17 for releasably locking the ball 21 in the open position in response to a preselected directional pressure in the bore 13. The locking means 50 includes a detent 51, a latch member 52, and an annular recess **16*i* formed in the surface 16*g* of the sleeve 16. The detent 51 is a ring-shaped member having a gap opening therein to enable radial expansion and contraction of the detent 51. The detent 51 is longitudinally movable along the surface 16*g* of the sleeve 16 from an upper or released position (FIG. 1A) to a lower or locked position (FIG. 7) where the detent 51 aligns with the recess 16*i* enabling radial contraction of the detent 51 into the recess 16*i*. The latch member 52 is a ring-shaped member mounted in the annular space between the sleeves 16 and 17 above the detent ring 51. The latch member 52 carries an O-ring 52*a* for sealing the latch 52 to the surface 16*g* of the sleeve 16 to block leakage of fluid therebetween. The latch member 52 carries an O-ring 52*b* to seal with a constant diameter inner surface 17*b* of the sleeve 17 to block leakage of fluid therebetween. By sealing the latch member 52 with the O-rings 52*a* and 52*b*, an upwardly facing pressure responsive annular shoulder surface 52*c* and a stepped downwardly facing pressure responsive annular shoulder surface 52*d* are provided for effecting longitudinal movement of the latch member 52. The upwardly facing shoulder surface 52*c* has a plurality of upwardly extending fingers 52*e* extending from the surface 52*c* to engage the downwardly facing shoulder 16*h* of the sleeve 16 to limit upwardly movement of the latch 52. The upper edge of the fingers 52*e* are rounded to enable communication among the openings between the fingers 52*e* when the fingers 52*e* engage the shoulder 16*h*. The sleeve 16 has a flow port 16*j* extending therethrough below the annular shoulder 16*h* to enable communication of the bore 13 and an expansible chamber 53. The expansible chamber 53 is formed by the surface 16*h*, the constant diameter surface 16*e* above the O-ring 52*a*, the surface 17*b* of the sleeve 17 located above the O-ring 52*b* and the upwardly facing annular shoulder surface 52*c* of the movable latch 52. Fluid pressure communicated from the bore 13 through the port 16*j* of the sleeve 16 into the expansible chamber 53 will urge downwardly on the surface 52*c* of the latch 52 to move the latch 52** downwardly to the locking position (FIG. 6).

The lower downwardly facing annular shoulder **52*d* of the latch 52 is stepped to provide a detent locking shoulder 52*f*. The detent 51 and the locking shoulder 52*f* of the latch 52 are dimensioned for locking the detent 51 in the recess 16*g* when the detent 51 is aligned with the recess 16*i* by the shoulder 52*f* moving within the detent 51 to block radial contraction of the detent 51. When the detent 51 is not aligned with the detent 16*i* the upwardly facing annular shoulder of the detent 51 engages the lower portion of the downwardly facing annular shoulder 52*d* of the latch 52 for moving the detent 51 to align with the recess 16*i***.

A preselected directional fluid pressure urging upwardly on the annular surface **52*d* will urge movement of the latch 52 to the upper position (FIG. 1A) for releasing the detent 51 from the recess 16*i*. The surface 16*g* of the sleeve 16 below the seal of the O-ring 52*a*, the downwardly facing annular shoulder 52*d* of the movable latch 52, the surface 17*b* of the sleeve 17 below the seal ring 52*b*, a portion of the surface 10*a*, the surface 10*b*, and the portion of the surface 10*c* above the seal effected by the packing 35, and an outer surface 32*e* of the piston sleeve 31 above the seal 35 define a lower expansible chamber 54. The sleeve 16 has a pair of ports of flow channels 16*k* and 16*m* formed therethrough adjacent the lower annular shoulder 16*f* of the sleeve 16 for communicating the pressure in the bore 13 with the lower expansible chamber 54. The ports 16*k* and 16*m* are spaced from the port 16*j* communicating with the chamber 53**.

The sleeve 32 extends upwardly from the tapered annular shoulder **32*f*** with a constant diameter inner surface 32*g* riding on the surface 16 of the sleeve 16 for providing an upper longitudinal movement guide for the piston means 30. The sleeve 32 extends upwardly from the shoulder 32*f* to form an upwardly facing annular shoulder 32*h* for engaging the downwardly facing shoulder of the detent 51 for moving the detent 51 upwardly from the recess 16*i* when the ring 52 is in the upper position. The sleeve 32 has a passage or opening 32*i* formed therethrough for communicating pressure in the bore 13 from either the port 16*k* of 16*m* into the lower expansible chamber 54.

In addition to urging upwardly on the effective surface area 52*d* of the latch 52, the pressure in the expansible chamber 54 will urge downwardly on the piston means 30 to urge the piston means 30 to move to the lower position for rotating the ball 21 open. The upwardly facing pressure responsive effective surface area of the piston means 30 is an annular surface provided by the sleeves 32 and 36 extending outwardly from the annular seal between the chevron packing 19 and the outer surface 33*i* of the sleeve 33 to the location where the chevron packing 35 effects an annular seal with the surface 10*c* of the tubular member 10. By sealing the piston means 30 in this manner, the pressure responsive effective surface area for urging the piston means 30 to move downwardly is identical in size to the pressure responsive effective surface area for urging the piston means 30 to move upwardly in response to the pressure in the expansible chamber 48.

The drilling tool T includes a bridge plug means 60 for the preselecting of a directional pressure for operating the means for releasably locking 50. Normally the pressure in the bore 13 is communicated into the upper chamber 53 and the lower chamber 54. Since the pressure responsive effective surface areas 52*c* and 52*d* of the latch 52 are equal, the pressure urging on the latch 52 is equal and offsetting and no net movement is imparted to the latch ring 52. The latch 52 has an annular recess 52*g* formed therein for carrying a radially expansible gapped detent ring 55 therein. The detent 55 is adapted to move into a recess 17*c* of the sleeve 17 when aligned therewith to block inadvertent movement of the latch 52 in response to a temporary pressure variation between the expansible chambers 53 and 54.

As illustrated in FIG. 6, the bridge plug means 60 includes a locking bridge plug 61 for communicating the pressure in the bore 13 to the chamber 53 for locking the ball 21 open. The locking bridge plug 61 includes a fluted seating collar 61*a* having a seating shoulder surface 61*b* for engaging an upwardly facing annular shoulder 16*n* of the sleeve 16 for positioning the locking plug 61 in the bore 13 of the tubular member 10. The collar 61*a* is fluted to enable communication of the pressure in the bore 13 above the plug 61 below the engaged shoulder 61*b*. The plug 61 carries an annular packing ring 61*c* to seal the plug 61 to the surface 16*e* of the sleeve 16 below the port 16*i* and above the port 16*k* when the seating shoulder 61*b* engages the shoulder 16*k* of the sleeve 16. By lowering the plug 61 down the bore of the drill string to seat within the bore 13 of the drilling tool T, a subsequent increase in pressure in the bore of the drill string above the plug 61 will be communicated through the port 16*j* into the expansible chamber 53. The seal of the packing ring 61*c* will block communication of this increased pressure into the chamber 54 between the plug 61 and the sleeve 16 by blocking the passage of fluid therebetween. The increased pressure in the expansible chamber 53 will urge the latch ring 52 to move downwardly to lock the detent 51 in the recess 16*i* to lock the ball 21 in the open position. The plug 61 has a vented fishing neck 61*d* secured to the upper portion of the plug 61 for enabling retrieval of the plug 61 back to the surface after locking the ball 21 open by wire-line recovery operation.

The bridge plug means 60 includes a crossover or releasing plug means 62 for providing a preselected directional pressure on the locking means 50 for releasing the ball 21. The releasing plug 62 is also inserted in the bore 13 of the tubular member 10 by lowering the plug 62 down the bore of the drill string until an annular seating collar 62*a* engages the upwardly facing shoulder 16*k* of the sleeve 16 with a downwardly facing shoulder surface 62*b*. Engagement of the shoulder 62*b* and 16*n* locks further downwardly movement of the plugs 62 as well as positioning a plurality of annular packing rings 62*c*, 62*d*, and 62*e* in the bore 13 for effecting the necessary operating pressure seals. The packing ring 62*c* blocks communication of fluid pressure between the releasing plug 62 and the surface 16*e* of the sleeve 16 above the port 16*f*. The packing ring 61*d* blocks communication of fluid pressure between the locking plug 62 and the surface 16*e* of the sleeve 16 below the port 16*h*. The packing ring 62*e* effects a fluid pressure communication blocking seal with a surface 32*i* of the piston means 30 below the flow port 32*i*. The plug 62 includes a substantially vertical channel or passageway 62*f* for communicating the fluid pressure in the bore 13 above the plug 62 with a horizontally disposed port 62*g* formed in the plug 62 for communicating the pressure above the plug 62 into the expansible chamber 54 through the ports 16*i* and 16*j*. The plug 62 has a horizontal flow port 120*h* positioned between the packing rings 62*c* and 62*d* communicating with a vertical cent or exit channel 62*i* which communicates the expansible chamber 53 with the bore 13 below the seal effected by the packing ring 62*d* to provide an exhaust passage or vent for the expansible chamber 53 as the latch 52 moves upwardly. By increasing the pressure in the bore 13 above plug 62 the increased pressure will be communicated into the expansible chamber 54 for urging on the pressure responsive surface 52*d* of the latch 52 for moving the latch 52 upwardly from within the detent 51 to release the detent 51 from the recess 16*i*. This enables the detent 51 to move out of the recess 16*g* when the upwardly urging on the piston means 40 is imparted to the detent 51 by the engaged surface 32*h* to move the detent 51 to the upper position. The unlocking plug 62 has a fishing neck 62*h* secured to the upper portion of the plug 62 to enable retrieval of the plug 62 from the bore 13 of the tubular member 10 by wire-line recovery operation.

The drilling tool T includes a stabbing means 70 for controlling an undesired upwardly flowing stream of fluid through the bore of the drilling string by sequentially enabling connection of the tubular member 10 with the drilling string while the ball 21 is maintained in the open position and after connection enabling the drilling tool T to return to the pressure responsive operation wherein the ball 21 is automatically rotated closed to control the undesired upwardly flowing stream of fluid. The stabbing means 70 includes a stabbing member or sleeve 71 which is provided with a left-handed thread 71*a* adapted for engagement with a corresponding thread 16*o* formed in the upper portion of the inner surface 16*e* of the sleeve 16. The initial engagement of the threads 71*a* and 16*o* also engages a lower annular shoulder 71*b* of the sleeve 71 with the annular shoulder 32*f* of the sleeve 32. Rotation of the sleeve 130 by use of a plurality of handles 71*c* secured to the upper portion of the sleeve 71 to bring the threads 16*o* and 71*a* into full engagement moves the engaged sleeve 32 downwardly to effect opening rotation of the ball 21. The sleeve 71 has a bore 71*d* therethrough which is aligned with the bore 13 of the tubular member 10 to enable flow through the bore 71*d* with a minimum of flow resistance which would interfere with aligning the drilling tool T with the drill string during the stabbing operation.

In the preferred use and operation of the present invention, the drilling tool T is connected in the drill string a short distance above the drill bit to provide continuous and automatic protection against well blowouts inside the bore of the drilling string. The drilling tool T is connected in the drilling string in the condition illustrated in FIGS. 1A and 1B. The piston means 30 is urged upwardly by the urging means 40 to rotate the ball 21 to the closed position. The detent 51 is in the upper position spaced from the locking recess 16*g*. The latch ring 52 is also in the upper position and is held there against inadvertent movement by the detent 55 moving in to the recess 17*c*. After completion of the drilling string connections, the driller will establish circulation of drilling fluid from the surface down the bore of the drill string to the drill bit. The drilling fluid will circulate through the ports or nozzles of the drill bit and back to the surface in the annular space of the drill hole about the exterior of the drill string including the drilling tool T. This circulation is established by increasing the output pressure of the mud pumps to force the drilling fluid down the bore of the drill string. As the pressure of the circulating drill fluid in the bore 13 above the ball 21 is increased to a pressure greater than the pressure in the bore 13 below the ball 31, the pressure differential urging on the ball 21 will overcome the upwardly urging of the spring 27 to move longitudinally downwardly the ball 21 and ring 28 until the fixed pins 24 engage the upper surface of the recesses 21*c*. This initial movement of the ball 21 spaces the spherical surface 21*a* of the ball 21 from the seating surface 25*a* of the seat ring 25 to prevent scoring or other damage to the seating surfaces 21*a* and 25*a* from abrasive material suspended in the drilling fluid when the ball 21 commences to rotate open. This longitudinal movement of the ball 21 also tends to equalize the pressure differential across the ball 21 to minimize the eroding action of the initial flow surge as the bore 22 rotates to align with the bore 13. The increased pressure in the bore 13 above the ball 21 is also communicated through the port 16*j* into the expansible chamber 53 for urging the latch ring 52 to move downwardly. This increased pressure is also communicated through the ports 16*o* and 32*i* into the expansible chamber 54 for urging on the pressure responsive surface 52*d* to urge the latch ring 52 to move upwardly. The equal pressure in the chambers 53 and 54 provide offsetting urging on the latch ring 52 and the latch ring 52 remains in the upper position.

Figure 4:
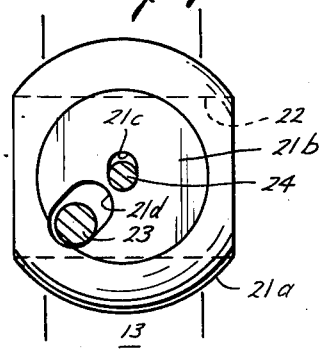
FIG. 4 is a view taken along line 4—4 of FIG. 3 with the ball in the closed position.
Figure 5:
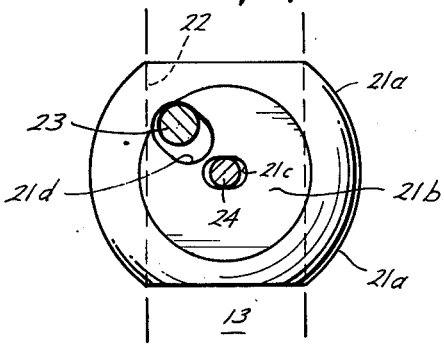
FIG. 5 is a view similar to FIG. 4 with the ball rotated to the open position.
Figure 8:
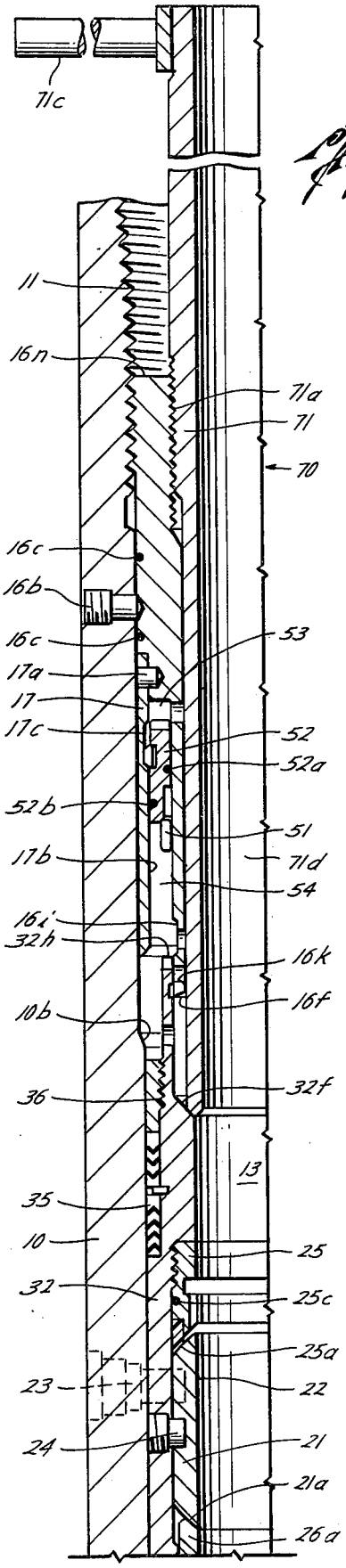
FIG. 8 is a view similar to FIG. 7 illustrating the ball locked open by a stabbing sleeve secured in the drilling tool.

The pressure communicated into the chamber 54 also urges downwardly on the upwardly facing pressure responsive effective surface area of the piston means 30 for urging the piston means 30 to move downwardly. When the increased pressure in the bore 31 above the ball 21 overcomes the combined upwardly urging on the piston means 30 of the spring 41 and the well annulus pressure communicated through the flow channel 14 into the chamber 48, the piston means 30 will move from the upper position (FIGS. 1A and 1B) to the lower position (FIGS. 2A and 2B). As the piston means 30 moves downwardly the pivot pins 24 positioned in the concentric recess 21*c* and secured to the sleeve 32 impart a longitudinal downward movement to the ball 21. This movement of the ball 21 enables the pins 23 positioned in the elongated recesses 21*d* and secured to the tubular member 10 to crank or effect a 90° rotation of the ball 21 to rotate the ball from the closed position (FIG. 4) to the open position (FIG. 5) with the bore 22 aligned with the bore 13 of the tubular member 10.

The upper and lower chevron packings 35 mounted on the sleeve 32 maintain their seals to block leakage of the increased pressure fluid in the bore 13 into the expansible chamber 48 as the piston means 30 moves between the upper and lower positions. Circulating drilling fluid within the chamber 48 is vented into the well annulus through the flow channel 14 as the piston means 30 moves downwardly. The downwardly movement of the piston means 30 to effect opening rotation of the ball 21 compresses the spring 41 which will effect closing rotation of the ball 21 when the pressure in the bore 13 no longer exceeds the circulating drilling fluid pressure adjacent the exterior surface 16 of the tubular member 10 communicated into the chamber 48 by a predetermined value which is determined by the spring constant of the spring 41. By sealing the piston means 30 with the packings 19 and 35, the net downwardly facing effective surface area for the pressure in the chamber 48 to urge on the piston means 30 is equal to the net upwardly facing effective surface area for the pressure in the bore 13 to urge downwardly on the piston means 30. This sealing arrangement enables the ball 31 to remain in the open position as long as the pressure in the bore 13 exceeds the pressure in the chamber 48 by the predetermined value.

Should the pressure of the drilling fluid being circulated in the bore of the drill string be reduced, or the pressure in the annulus of the well communicated through the port 14 into the expansible chamber 48 be increased, such as by encountering well blowout pressures, the ball 21 will automatically be rotated to the closed position to control any flow of fluid up the bore of the drill string resulting from the changed pressure conditions. The differential pressure urging the piston means 30 downwardly will be reduced by the occurrence of either pressure change and will enable the urging of the spring 41 to move the piston means 30 upwardly when the pressure differential urging on the piston means 30 no longer exceeds the predetermined value. The upwardly movement of the piston means 40 will impart an upwardly movement to the ball 21 with the pins 24 to effect a cranking motion of the ball 21 by the pins 23 to rotate the ball 21 90° from the open position to the closed position with the bore 22 transverse to the bore 13 of the tubular member 10. The drilling tool T, by sensing these incipient pressure changes, rotates the ball 21 to block the flow of fluid upwardly through the bore 13 of the tubular member 10 before the well pressure communicated through the drill bit nozzles can effect upwardly flow through the bore of the drill string.

When it is desired to lock the ball 21 in the open position for running other well tools through the bore of the drill string or for lowering the drill string into the well without the need to fill the bore of the drill string above the ball, the locking plug 61 is lowered down the bore of the drill string until the shoulder 61*b* seats upon the shoulder 16*n* for positioning the locking plug 61 in the tubular member 10. The pressure in the bore of the drill string above the plug 110 is then increased to provide a directional pressure urging on the latch ring 52. The increased pressure in the bore 13 above the plug 61 is communicated into the expansible chamber 53 through the port 16*j* but is blocked from communicating with the expansible chamber 54 by the seal effected by the packing ring 61*c*. The increased pressure communicated into the expansible chamber 53 urges on the surface 51*c* to urge the latch ring 52 to move downwardly. The downwardly urging will initially force the detent ring 55 to radially contract into the recess 52*g* to enable the latch ring 52 to move downwardly. The initial movement of the latch ring 52 engages the lower portion of the shoulder surface 52*d* with the upper shoulder of the detent 51 which is in engagement with the annular shoulder 32*h* of the piston sleeve 32. The downwardly urging provided to the latch ring 52 by the pressure in the chamber 53 will then overcome the combined upwardly urging of the spring 41 and the pressure in the chamber 48 to move downwardly the piston means 30, the detent 51 and the latch member 52. The downwardly movement of the piston means 30 to the lower position will effect opening rotation of the ball 21 to align the bore 22 with the bore 13 of the tubular member 10. As illustrated in FIG. 6, when the piston means 30 is in the lower position the detent 51 is aligned with the recess 16*i* wherein the detent ring 51 radially contracts to move into the recess 16*g*. This movement of the detent 51 enables the latch 51 to continue to move downwardly alongside the detent 51 to lock the detent 51 in the recess 16*i* with the locking shoulder 52*f* blocking radial expansion of the detent 51 out of the recess 16*g*. The lower shoulder of the locked detent 51 is maintained in engagement with the annular shoulder 32*h* of the sleeve 32 to maintain the piston means 30 in the lower position rendering the pressure responsive automatic control of the drilling tool inoperable. The detent engages an upper tapered edge 16*p* of the recess 16*i* for blocking upwardly movement of the detent 16*p*. The locking plug 61 may be retrieved from the bore 13 of the drilling tool T by connecting a wire line fishing tool with fishing neck 61*d* for removing the plug 61. Other well tools may be then run through the full opening bore 13 of the tubular member 10 as desired.

When the driller desires to return the drilling tool T to automatic pressure responsive operation, the releasing plug 62 is lowered down the bore of the drill string until the shoulder 62*b* engages the shoulder 16*n* of the sleeve 16 for positioning the releasing plug 62 in the bore 13 of the tubular member 10. The pressure in the bore of the drill string above the releasing plugs 62 is then increased. The increased pressure in communicated through the channel 62*f* and the port 62*g* of the unlocking plug 62 into the expansible chamber 54 below the latch ring 52. The releasing plug 62 blocks communication of this increased pressure into the expansible chamber 53 by the pressure blocking seal effected by the packing rings 62*c* and 62*d*. The increased pressure in the chamber 54 will urge on the surface 52*d* of the latch 52 to move the latch 52 upwardly to the upper position thereby moving the locking shoulder 52*f* from within the detent 51 enabling radially expansion of the detent ring 51 from the locking recess 16*g*. The increased pressure in the chamber 54 will also urge downwardly on the piston means 30 to overcome the combined upwardly urging of the pressure in the chamber 48 and the spring 41 to maintain the piston means 30 in the lower position. The selection of the locking plug 61 or the releasing plug 62 preselects the directional pressure to be applied to the releasable locking means 50 by the bridge plug means 60.

When the pressure in the bore of the drill string above the plug 62 is reduced, the combined upwardly urging of the spring 41 and the pressure in the chamber 48 will urge the piston means 30 to move upwardly which will rotate the ball 21 from the open position back to the closed position. The upwardly movement of the piston means 30 will wedge or force the detent 51 to contract by engagement with the tapered surface 16*p* to move out of the recess 161 and back to the upper position by engagement with the shoulder 32*h*. The releasing plug 62 may then be retrieved back from the bore 13 of the tool T to enable resumption of normal drilling operations by connecting a wire line fishing tool with a fishing neck 52*h*.

Should the driller desire not to employ the drilling tool T connected in the drill string during drilling the tool T may still be employed to protect against inside the drilling string blowouts. To prepare the drilling tool T for use in this manner, the stabbing sleeve 71 is inserted in the bore 13 of the tubular member 10 and the threads 16*o* and 71*a* are brought into engagement by rotating the sleeve 71 with the handles 71*c*. As the sleeve 71 is rotated to engage the threads 16*o* and 71*a*, the lower annular shoulder 71*b* engages the shoulder 32*f* of the sleeve 32 for forcing the piston means 30 downwardly to rotate open the ball 21 by overcoming the upwardly urging of the spring 41 and the atmospheric pressure in the expansible chamber 48. It will be immediately appreciated that with the stabbing sleeve 71 secured in the bore 13 of the drilling tool 10, the handles 71*c* will block connection of the drill string above the well tool T. With the ball 21 rotated open the drilling tool T is now ready for stabbing in the drill string when an upwardly flow occurs in the bore of the drill string.

When the undesired upwardly flow occurs, the drilling tool T is elevated above the open ended drill pipe having the undesired flow through the bore to align the bore 13 of the tubular member 10 with the bore of the drill pipe. With the ball 21 maintained in the open position by the sleeve 71, the tool T may be lowered to stab the threaded pin connection 12 into an upper box connection of the drill string with only a minimum amount of interference with the stabbing operation by the upwardly flowing stream of fluid from the bore of the drill string. When the aligned threaded pin connection 12 engages the drill string the drilling tool T is rotated to fully engage with the threaded box connection of the drill string to connect the tool T with the drill string. After connecting the drilling tool T with the drill string, the handles 71*c* are then utilized to rotate the sleeve 71 from the bore 13 of the tubular member 10. As the sleeve 71 is rotated to effect removal from the bore 13, the combined upwardly urging of the spring 41 and the atmospheric pressure in the expansible chamber 48 will overcome the downwardly uging provided by the flowing stream of fluid in the bore 13 exhausting to atmospheric pressure adjacent the upper box threads 11 to move the piston means 30 upwardly to effect closing rotation of the ball 21. The ball 21 is rotated fully closed to block flow through the bore 13 prior to complet disengagement of the threads 71*a* and 16*m* to eliminate the hazard of the sleeve 71 being hurled from the bore 13 by the flow out flow.

The foregoing disclosure and description of the invention are illustrative and explanatory thereof, and various changes in the size, shape, and materials as well as in the details of the illustrated construction may be made without departing from the spirit of the invention.

I claim:

1. A drilling tool adapted for connection in a drill string to control undesired flow of fluids through the bore of the drill string including:

a tubular member having an exterior surface and a bore therethrough and adapted for connection at its upper and lower ends in a drill string with said bore in communication with the bore of the drill string;

bore closure means mounted with said tubular member and having a seat and a movable closure member for pivoting movement to and from an open position for enabling flow of fluids through said bore of said tubular member and a closed position engaging said seat for blocking flow of fluids through said bore of said tubular member, said bore closure means including means for spacing said closure member from said seat prior to imparting pivoting movement to said member to effect movement from the closed position to the open position; and piston means operably connected with said closure member for urging movement of said closure member to the open position when the pressure in said bore for enabling the desired flow exceeds the pressure adjacent said tubular member exterior surface by a predetermined value, said piston means mounting said seat for movement with said piston means to engage said closure member when said closure member is in the open position wherein the drilling tool is opened to enable flow of fluids through the bore of the drilling string.

2. The apparatus as set forth in claim 1, wherein said closure member includes a ball-type valve member having an opening therethrough for rotational movement to and from open and closed positions.

3. The apparatus as set forth in claim 1, including means for releasably locking said bore closure means in the open position wherein said bore closure means is rendered inoperative to control flow through the bore of the drill string.

4. The apparatus as set forth in claim 1, including stabbing means for controlling an undesired flowing stream of fluid through the bore of the drilling string by sequentially enabling connection of said tubular member with the drilling string with said bore closure means maintained in the open position and thereafter enabling said bore closure means to move to the closed position wherein the undesired flowing stream is controlled.

5. The apparatus as set forth in claim 1, wherein said piston means includes a piston sleeve movably disposed in said bore of said tubular member and having a first pressure response surface area for urging movement of said piston sleeve in a first direction to operate said bore closure means to the open position when the pressure in said bore for enabling the desired flow exceeds the pressure adjacent said tubular member exterior surface.

6. The apparatus as set forth in claim 5, wherein:

(a) said piston sleeve and said tubular member form an expansible chamber therebetween;

(b) said piston sleeve having a second pressure responsive surface for urging movement of said piston means in a second direction to operate said bore closure means to the closed position in response to the pressure in said expansible chamber; and (c) a flow channel formed in said tubular member and extending from a location on said exterior surface of said tubular member to communicate the pressure adjacent said tubular member with said expansible chamber wherein the pressure adjacent said tubular member urges said bore closure means to move to block through said bore of said drill string.

7. The apparatus as set forth in claim 6, including means for sealing said expansible chamber to block leakage of fluid between said bore of said tubular member and said expansible chamber wherein flow of fluid from said bore of said tubular member through said flow channel is blocked.

8. The apparatus as set forth in claim 7, including means mounted with said tubular member for urging movement of said piston sleeve in the second direction to move said bore closure means to the closed position when the pressure in said bore of said tubular member exceeds the pressure adjacent the exterior to said tubular member communicated into said expansible chamber by less than the predetermined pressure.

9. The apparatus as set forth in claim 8, including stabbing means for controlling an undesired flowing stream of fluid through the bore of the drilling string by sequentially enabling connection of said tubular member with the drilling string with said bore closure means maintained in the open position and thereafter enabling said bore closure means to move to the closed position wherein the undesired flowing stream of fluid is controlled.

10. The apparatus as set forth in claim 9, wherein said stabbing means includes a stabbing member removably secured in said bore of said tubular member for engaging said piston sleeve to maintain said bore closure means in the open position, said bore closure means moving to the closed position when the stabbing member is removed from said bore wherein the undesired flowing stream of fluid is controlled.

11. The apparatus as set forth in claim 8, wherein said bore closure means includes a ball-type valve closure member having an opening therethrough for rotational movement to and from the open and closed positions when said piston sleeve member moves in response to the urgings thereon.

12. The apparatus as set forth in claim 11, wherein said bore closure means further includes:

(a) said seat forming a ring having a sealing surface engaging said ball member for blocking flow of fluid between said ball and said seat ring; and (b) said means for spacing moving said ball member from said sealing surface of said seat ring prior to commencing to effect rotation of said ball member to the open position by movement of said pistion sleeve wherein the spacing movement of said ball member protects said sealing surface from wear.

13. The apparatus as set forth in claim 11, wherein said ball member is pivotally mounted with said tubular member.

14. The apparatus as set forth in claim 13, wherein said piston sleeve is pivotally connected with said ball member for imparting rotation to said ball member when said piston sleeve moves in response to the urgings thereon.

15. The apparatus as set forth in claim 11, including means for releasably locking said bore closure means in the open position wherein said bore closure means is rendered inoperative to control flow through the bore of the drill string.

16. The apparatus as set forth in claim 15, wherein said means for releasably locking said bore closure means in the open position includes:

(a) said bore of said tubular member defining a surface having a recess therein;

(b) a latch assembly movably disposed in said bore of said tubular member for movement when a preselected directional pressure urges thereon to and from a released position enabling pressure responsive movement of said bore closure means and to and from a locking position for blocking movement of said bore closure means from the open position to the closed position; and (c) a detent member movable into said recess when said latch assembly is in the locking position, said detent member latched in said recess by said latch assembly to secure said latch assembly in the locking position when the preselected directional pressure for locking said bore closure is reduced wherein said bore closure means is rendered inoperative to control flow through the bore of the drill string.

17. The apparatus as set forth in claim 16, wherein said latch assembly includes:

(a) a detent latching member having a first pressure responsive area for urging said latch assembly to the locking position in response to the preselected directional pressure urging thereon and a second pressure responsive surface area for urging said detent latching member to release said detent from said recess in response to the preselected directional pressure urging thereon;

(b) a latch assembly movement control sleeve movably disposed in said bore of said tubular member for forming a first expansible chamber therebetween for providing pressure urging to said first pressure responsive surface of said detent latching member through a first passageway formed in said sleeve to communicate the pressure in said bore of said tubular member with said first pressure responsive surface, said sleeve and said tubular member forming a second expansible chamber therebetween for providing pressure urging to said second pressure responsive surface of said detent latching member through a second passageway formed in said sleeve to communicate the pressure in said bore of said tubular member with said second pressure responsive surface for normally providing equal pressure urging on said detent latching member; and (c) said first passageway and said second passageway spaced a sufficient distance to receive a plug means therebetween to control the directional pressure urging on said latch device wherein the operating movements of said latch device are effected.

18. A method of operating a safety valve connected in a well tubing for controlling flow of fluid in an undesired direction through the bore of a well tubing, including the steps of:

sensing the pressure in the bore of the well tubing for enabling flow in the desired direction through the bore;

sensing the pressure adjacent the exterior of the safety valve;

comparing the pressure in the bore with the pressure adjacent the exterior of the safety valve to determine the pressure differential;

rotating a flow blocking member for opening the safety valve to enable flow of fluid through the bore of the tubing when the pressure in the bore of the tubing exceeds the pressure adjacent the exterior of the safety valve by a predetermined value;

spacing the rotatable flow blocking portion of the safety valve from a safety valve seat prior to the step of rotating open the flow blocking portion of the safety valve; and moving the flow blocking member back into engagement with the seat when the flow blocking member is rotated open.

19. The method as set forth in claim 18, including the step of moving a safety valve operator in response to the pressure differential to impart rotational movement to the member.

20. The method as set forth in claim 18, including the step of locking the opened safety valve in the open position to render the safety valve inoperative to control flow of fluid through the bore of a well tubing.

21. The method as set forth in claim 20, including the step of releasing the locked open safety valve to enable the safety valve to control flow of fluid in the undesired direction through the bore of the well tubing.

22. A method of controlling a flowing stream of fluid from a bore of a well tubing by stabbing a pressure responsive safety valve for operating to block the stream including the steps of:

(a) locking the safety valve open to enable flow therethrough by securing a lock member in the valve;

(b) connecting the safety valve with the well tubing conducting the flowing stream of fluid;

(c) removing the lock member to enable pressure responsive operation of the safety valve; and (d) rotating a flow blocking member about a fixed axis for closing the valve to block the flow from the bore of the tubing when the pressure in the bore of the tubing exceeds the pressure adjacent the exterior of the safety valve by less than a predetermined value.

23. The method as set forth in claim 22, including the step of rotating the member about a fixed axis for opening the valve to enable flow through the bore of the well tubing when the pressure in the bore of the tubing exceeds the pressure adjacent the exterior of the safety valve by less than a preselected pressure.

24. A ball-type valve tool apparatus for use in wells, including:

a tubular member having a bore therethrough;

a seat movably disposed in said bore;

a ball-type valve member disposed in said bore and having an opening therethrough, said ball-type valve member rotatable to and from an open position for enabling flow of fluid through said bore and said opening and a closed position in sealing engagement with said seat for blocking flow of fluid through said bore of said tubular member;

means operably connected with said ball-type valve member for rotating said bell-type valve member to and from the open and closed positions; and means for spacing said ball-type valve member from said seat prior to commencing to effect rotation of said ball-type valve member to the open position to prevent damage to said seat or said ball-type valve member during such opening rotation, said seat engaging with said ball-type valve member after rotation to the open position.

25. The apparatus as set forth in claim 24 wherein:

said ball-type valve member moves from seating engagement with said seat for spacing prior to commencing to rotate open.

26. The apparatus as set forth in claim 25, including:

means for releasably locking said bore closure means in the open position wherein said bore closure means is rendered inoperative to control flow through said bore.

27. A ball-type valve tool apparatus for use in wells, including:

a tubular member having a bore therethrough;

a seat disposed in said bore;

a ball-type valve member disposed in said bore and having an opening therethrough, said ball-type valve member rotatable to and from an open position for enabling flow of fluid through said bore and said opening and a closed position in sealing engagement with said seat for blocking flow of fluid through said bore of said tubular member;

means operably connected with said ball-type valve member for rotating said ball-type valve member to and from the open and closed positions; and means for spacing said ball-type valve member from said seat prior to commencing to effect rotation of said ball-type valve member to the open position to equalize the fluid pressure in said bore about said ball-type valve member.

28. The apparatus as set forth in claim 27, wherein:

said ball-type valve member moves from seating engagement with said seat for spacing prior to commencing to rotate open.

29. The apparatus as set forth in claim 27, including:

means for releasably locking said bore closure means in the open position wherein said bore closure means is rendered inoperative to control flow through said bore.

* * * * *